US006371093B1

(12) United States Patent
Kaku et al.

(10) Patent No.: US 6,371,093 B1
(45) **Date of Patent: *Apr. 16, 2002**

(54) FUEL AIR INJECTOR

(75) Inventors: Junichi Kaku; Tokuji Muramatsu, both of Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

This patent is subject to a terminal disclaimer.

(21) Appl. No.: 07/895,203

(22) Filed: Jun. 8, 1992

Related U.S. Application Data

(63) Continuation of application No. 07/675,793, filed on Mar. 27, 1991, which is a continuation-in-part of application No. 07/672,888, filed on Mar. 21, 1991.

(30) Foreign Application Priority Data

Mar. 23, 1990 (JP) ..... 2-75309

(51) Int. Cl.[7] ..... F02M 23/00
(52) U.S. Cl. ..... 123/531
(58) Field of Search ..... 123/531, 305, 123/301, 533; 239/453, 585

(56) References Cited

U.S. PATENT DOCUMENTS 4,499,861 A * 2/1985 Wiegand et al. ..... 123/305
4,499,871 A * 2/1985 Neitz et al. ..... 123/305
4,753,213 A * 6/1988 Schlunke et al. ..... 123/305

* cited by examiner

*Primary Examiner*—John Kwon
*Assistant Examiner*—Hien T. Vo
(74) *Attorney, Agent, or Firm*—Ernest A. Beutler

(57) ABSTRACT

Four embodiments of fuel air injectors wherein variations in the amount of fuel discharged due to the existence of pressure variations between the injector valve and its seat in the fuel injector are minimized. This is done by provided a restricted orifice downstream of the point of fuel injection so that combustion chamber pressures are dampened from the fuel injector. In all embodiments of the invention the injector valve is a poppet valve having a configured stem portion for slideably supporting the poppet valve within the housing while permitting flow therepast. In two embodiments, the fuel is delivered to the injector above the configured portion of the poppet valve and in two embodiments the fuel is delivered below the configured portion of the poppet valve for improving responsiveness.

15 Claims, 7 Drawing Sheets

FUEL AIR INJECTOR

This is a continuation of U.S. patent application Ser. No. 07/675,793, filed Mar. 27, 1991 which application is a continuation in part application Ser. No. 07/672,888 filed Mar. 21, 1991.

BACKGROUND OF THE INVENTION

This invention relates to fuel air injector and more particularly to a fuel air injector for an internal combustion engine.

One common type of fuel injector for an internal combustion engine and, in fact, one of the earliest type of injectors used with such engines, comprises a housing that a defines a chamber into which fuel is injected. This chamber communicates with the combustion chamber of the engine through a nozzle port and an injector valve controls the communication of the chamber through this nozzle port with the combustion chamber.

This type of fuel injector has certain advantages in conjunction with two cycle engines although it can be applied equally as well with four cycle engines. However, there is a disadvantage with this type of fuel injector in that the control of the amount of fuel discharged can be somewhat difficult and may be depend on variations in the running condition. One reason for this is that the fuel is injected into a chamber which communicates with the combustion chamber through a valve having a valve member and a valve seat. The clearances between the valve member and valve seat when in their open position can vary due to a number of factors and also the pressure in the combustion chamber may vary. That is, if fuel is injected at any time when the injector valve is opened, than the pressure variations in the pressure in the combustion chamber and variations in pressure within the chamber of the fuel injector due to differences in the distance between the valve seat and valve member can cause variations in the amount of fuel injected. This problem can be particularly acute at times when the compression ratio is high, and the injector valve is opened and fuel is being injected by the fuel injector.

It is, therefore, a principal object of this invention to provide an air fuel injector having a construction which will insure that the amount of fuel injected will not be dependent upon the pressure in the chamber into which the fuel injector discharges or clearances between the valve member and valve seat.

It is a further object of this invention to provide an improved air fuel injector in which the amount of fuel injected will be independent of variations in pressure and differences in clearance between the valve member and the valve seat of the injector valve.

SUMMARY OF THE INVENTION

This invention is adapted to be embodied in an air fuel injector for injecting fuel and air into a high pressure area of an internal combustion engine. The injector comprises a housing that defines a chamber and a nozzle port for communicating the chamber with the high pressure area of the engine. An injector valve is provided for opening and closing the communication of the chamber with the high pressure area. A fuel injector injects fuel into the chamber. Means are provided for restricting the communication of the area between the injector valve and the nozzle port with the area of the chamber to which fuel is injected by the fuel injector at least when the injection valve is opened.

DETAILED DESCRIPTION OF THE PREFERRED EMBODIMENTS OF THE INVENTION

Figure 1:
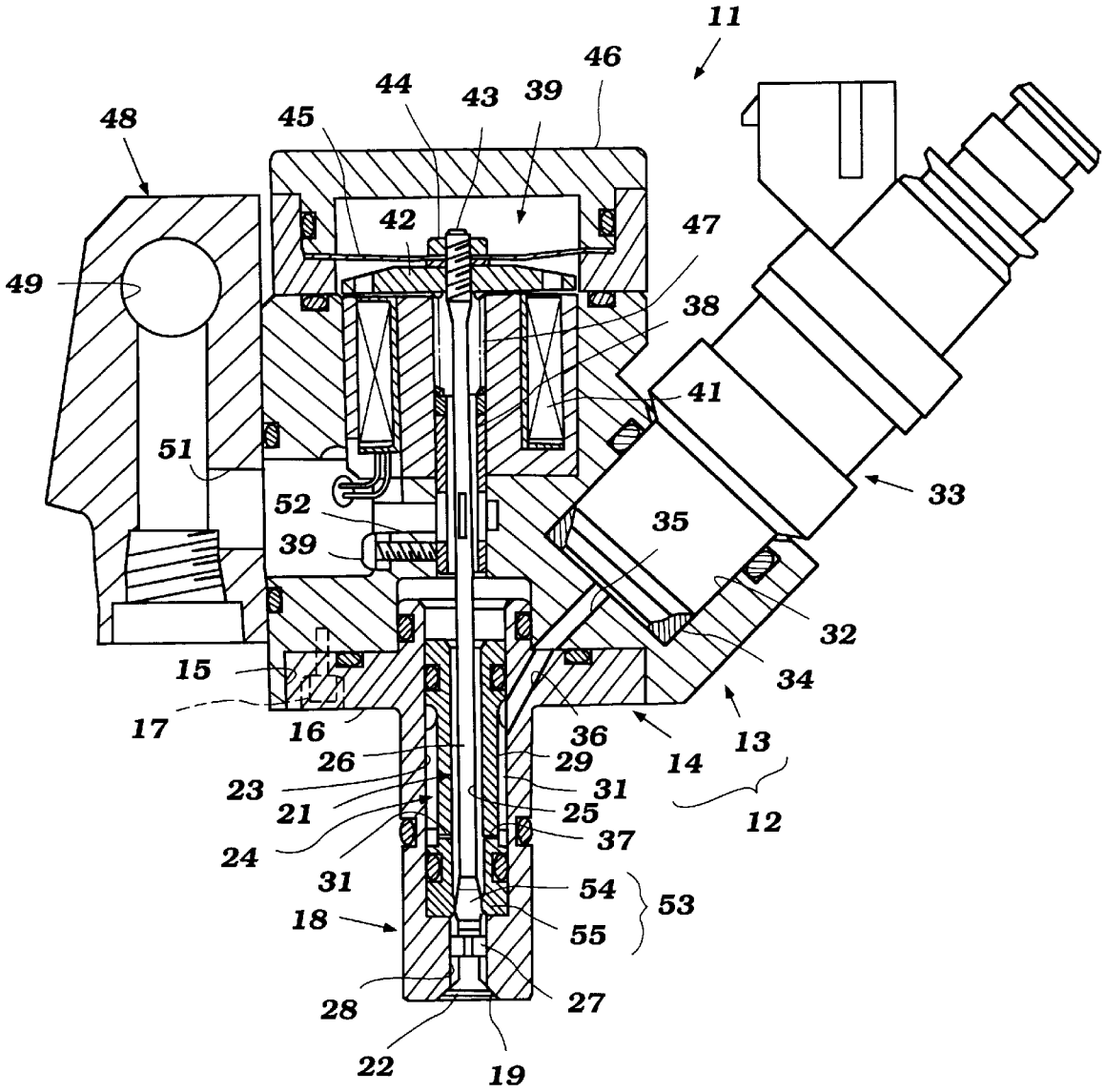
FIG. 1 is a cross sectional view taken through an air fuel injector constructed in accordance with an embodiment of the invention.
Figure 2:
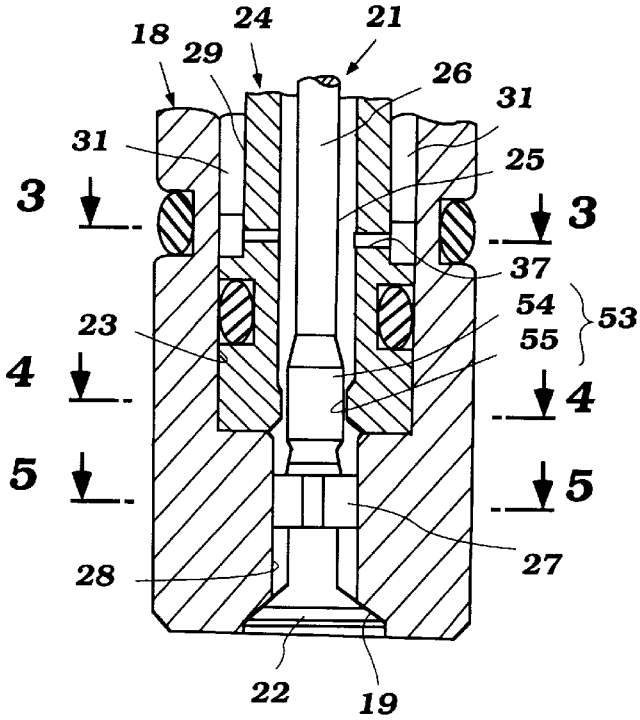
FIG. 2 is a further enlarged cross sectional view taken through a portion of the fuel injector.
Figure 3:
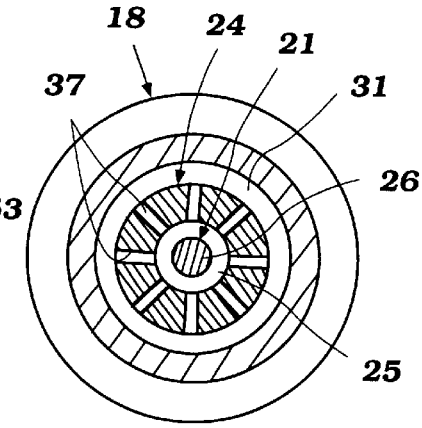
FIG. 3 is a cross sectional view taken along the line 3—3 of FIG. 2.
Figure 4:
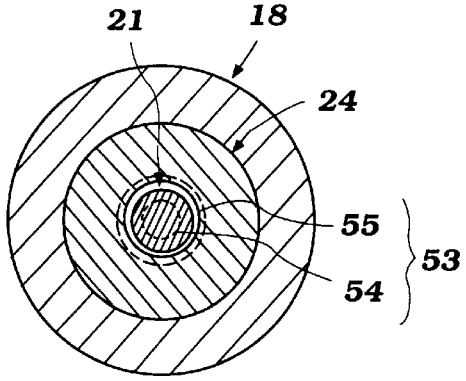
FIG. 4 is a cross sectional view taken along the line 4—4 of FIG. 2.
Figure 5:
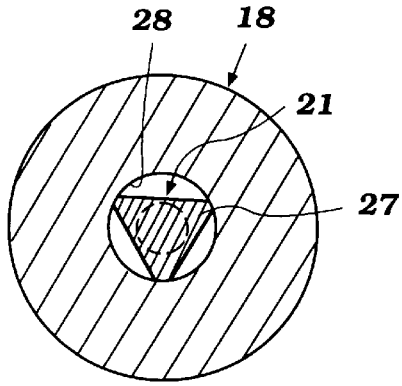
FIG. 5 is a cross sectional view taken along the line 5—5 of FIG. 2.

Referring now in detail to the drawings and first the embodiment of FIGS. 1 through 5, an air fuel injector constructed in accordance with this embodiment is identified generally by the reference numeral 11. The air fuel injector 11 is designed and constructed so as to inject a quantity of fuel and air into the combustion chamber of a two cycle crankcase compression internal combustion engine. Although the invention is described in conjunction with such applications, it should be understood that the invention can be practiced in conjunction with other types of internal combustion engines and in conjunction with the injection into areas other than the combustion chamber of the engine. However, for reason which will become readily apparent, the invention has particular utility in conjunction with direct cylinder injection.

The injector 11 includes a housing assembly, indicated generally by the reference numeral 12 comprised of a main housing part 13 and a nozzle part 14. The main housing part 13 is provided with a counter bore 15 on its lower face that receives a cylindrical section 16 of the nozzle part 14. Socket-headed screws 17 affix the housing parts 13 and 14 to each other.

The nozzle piece 14 has a cylindrical pilot section 18 that is adapted to be received in an appropriate bore in the engine, such as the cylinder head, and which terminates in a nozzle port or valve seat 19 at its lower end. An injector valve, indicated generally by the reference numeral 21, has a headed portion 22 that cooperates with the nozzle port or valve seat 19 so as to control the flow therethrough.

The cylindrical pilot section 18 is formed with a bore 23 in which an insert piece, indicated generally by the reference numeral 24 is affixed. The insert piece 24 has its own internal bore which defines a chamber 25 that extends around a stem portion 26 of the injector valve 21. At the lower end of the stem portion 26, there is provided a triangular shaped section 27 (FIG. 5) that serves to slideably support the injector valve 21 in a bore 28 of the nozzle part 14 while permitting fluid flow therepast. Compressed air is supplied, in a manner to be described, to the chamber 25.

The insert piece 24 has a reduced diameter section 29 that provides a fuel chamber 31 surrounding the insert piece 24 and formed between the reduced diameter portion 29 and the bore 23 of the nozzle part 18. Fuel is delivered to the fuel chamber 31 in a manner to be described.

The main housing piece 13 of the injector housing 12 is provided with an angularly disposed bore 32 in which a fuel injector, indicated generally by the reference numeral 33 is mounted. The bore 32 is disposed at an acute angle to the longitudinal axis of the housing assembly 12 so that the fuel injector 33 may be conveniently inserted and removed while, at the same time, affording a compact configuration.

A seal 34 is provided at the lower end of the bore 32 and is engaged by the nose of the fuel injector 33 to provide sealing. The injector 33, which is supplied with fuel from a fuel supply system of any known type and which injector 33 may be electrically actuated, has a discharge nozzle (not shown) that is aligned with a port 35 formed in the housing piece 13. The port 35 is aligned with a further port 36 formed in the nozzle piece 14 and which port 36 communicates with the fuel chamber 31. As a result, when the injector 33 is actuated, fuel will flow from its nozzle port through the passages 35 and 36 to the fuel chamber 31. This fuel may then flow through a plurality of radially extending ports 37 to enter into the chamber 25.

The injector valve stem portion 26 extends up through a bore formed in the housing piece 13 in which a sleeve 38 is held by means of a set screw 40. The upper portion of the sleeve is surrounded by a solenoid assembly, indicated generally by the reference numeral 39, which functions to actuate the injection valve 21. The solenoid 39 includes a winding 41 which encircles the bore in which the sleeve 38 is positioned and which is energized in a suitable manner. An armature plate 42 is affixed to the upper end of the injection valve stem 26 by means of a threaded portion 43 thereof and a nut 44. A diaphragm type seal 45 is also affixed between the nut 44 and the armature 42. The outer peripheral edge of the diaphragm seal 45 is secured in place by a solenoid cover assembly 46 for sealing purposes.

A coil compression spring 47 engages the armature plate 42 and normally urges the injector valve 21 to a closed position wherein the head portion 22 is sealingly engaged with the valve seat 19. When the solenoid coil 41 is energized, the armature plate 42 will be urged downwardly compressing the spring 47 and moving the injector valve 21 to its opened position.

Air is supplied to the chamber 25 from an air manifold, indicating generally by the reference numeral 48 and which is affixed to the one side of the injector housing assembly 12 in suitable manner. An air inlet port 49 extends through the air manifold 48 and communicates with a side passageway 51 that delivers compressed air to a port 52 formed in the sleeve 38. This permits air to then flow downwardly around the outer peripheral edge of the injection valve stem 26 to the chamber 25.

Although a wide variety of control sequences may be employed, normally compressed air will be present in the chamber 25 at all times when the injection valve 21 is closed due to the open communication with the air supply manifold 48. Fuel is injected at some time by energizing the fuel injector 33 and the period of fuel injection, although it may vary depending on the particular desired application, will also occur during such time as when the injector valve 21 is opened. The fuel injected is thus carried by the air under pressure from the chamber 25 into the combustion chamber of the engine for combustion. However, since the fuel injector 35 is discharging into the chamber 25 at a time when the injection valve 21 is opened, than there will be communication of the chamber 25 with the combustion chamber the clearance volume between the head 22 of the injector valve and the valve seat or nozzle port 19 may vary due to manufacturing variances and/or deformation of the valve components. These area variations along with variations in pressure in the combustion chamber and the effect of this on the fuel injection may be understood by reference to FIG. 6.

Figure 6:
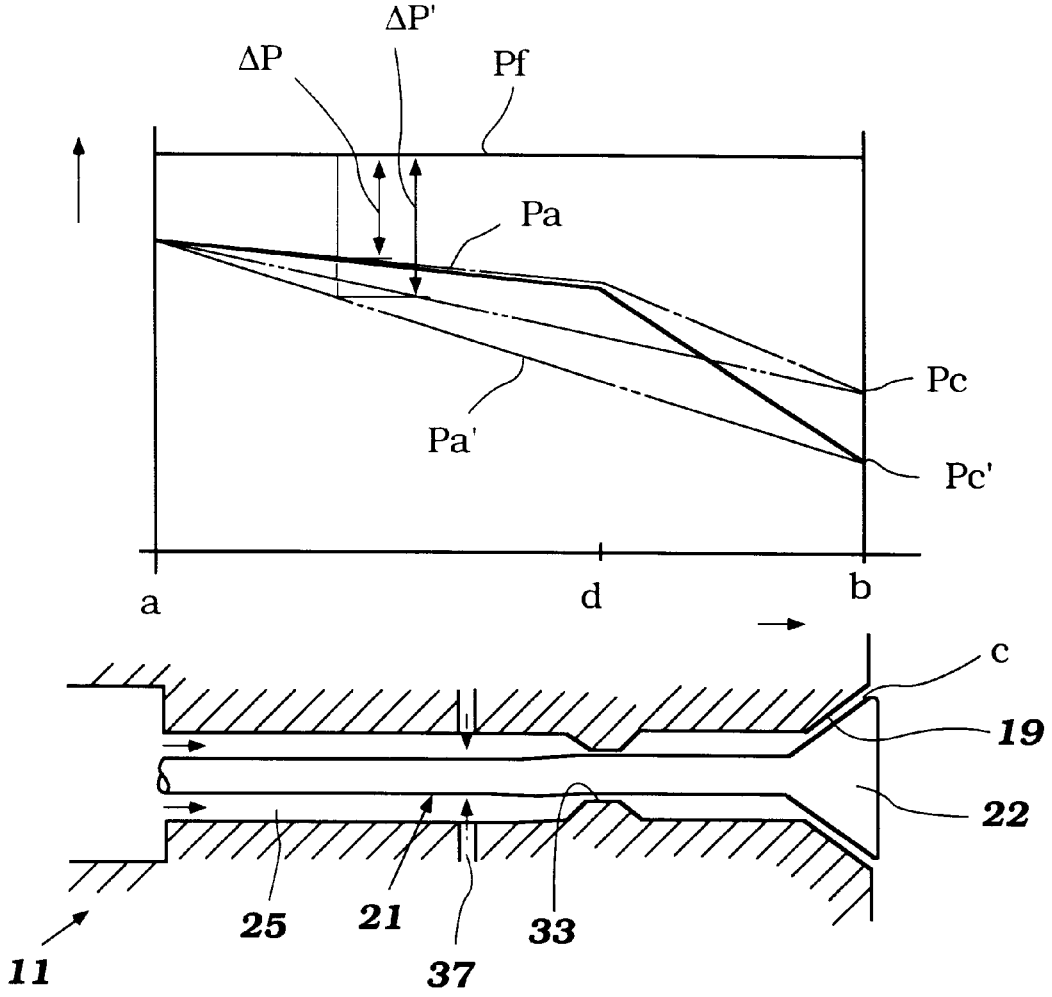
FIG. 6 is a graphical view showing the interrelationship between the pressure in the combustion chamber and at various places along the length of the chamber of the air fuel injector.

FIG. 6 is a graphical view showing the pressure traces at various points in the fuel injector 11 during times when the injection valve 21 is opened. Referring to the graph at the top portion of this curve, the pressure of fuel injected by the fuel injector is indicated by the line "Pf" and this may be considered to be a constant pressure. The air pressure existent in the chamber 25 is indicated by the curve "Pa". The amount of fuel discharged will be dependent upon the pressure differential between the pressure "Pf" and the pressure "Pa" (▲P). However, this pressure differential ▲P is dependent upon a factor in addition to the air pressure Pa' and the fuel pressure Pf'. This is because when the injection valve 21 is opened, a pressure "Pc" can enter into the chamber 25 through the clearance "C" between the injector valve head 22 and the valve seat 19. The pressure "Pc" will be determined by the combustion chamber pressure and also the clearance between the head 22 of the injector valve and the valve seat or nozzle port 19. This clearance can change due to manufacturing irregularities and also due to deformation of the components which occurs during the life of the injector. If the pressure is permitted to flow unrestricted to the ports 37 and, accordingly, to be transmitted to the outlet nozzle of the fuel injector 33 it may be seen from the family of -..- curves in FIG. 6 that the amount of fuel discharged will be dependent directly upon the pressure Pc. The curve Pc' shows the pressure when the clearance between the injector valve head 22 and the nozzle port 19 is relatively small. For example, when the pressure Pc is high as shown by the curve "Pc" than the total air pressure ▲Pa" at the nozzle port 37 will be relatively high and there will be a low pressure difference ▲P" that will permit a low amount of fuel injection. However, as the pressure Pc decreases as shown by the curve Pc' than the pressure difference ▲P is substantially higher and there will be a substantially greater amount of fuel discharge. Hence, it will be difficult, if pressure between the valve seat or nozzle port 19 and the valve head 22 can be present at the discharge port of the fuel injector 35 to maintain appropriate fuel control under all conditions.

In accordance with the invention, there is provided a flow restricting orifice, indicated generally by the reference numeral 53 which, in this embodiment, is positioned downstream of the chamber 25 from both the point of air and fuel admission and between the point of air and fuel admission and the injector valve seat 19. This orifice 53 is provided by a cylindrical enlargement 54 formed on the injector valve stem and a reduced diameter portion 55 formed by the insert piece 24 at its lower end. It should be noted that this orifice 53 is sized so as to not obstruct the amount of fuel and air that can be injected but to reduce the pressure variation which will be present at the ports 37 when the injector valve experiences combustion chamber pressure as may be clearly shown by the solid and .- curves of FIG. 6. These curves show the actual pressure at various points along the injector and particularly indicate the dampening action of the orifice 53 upstream of orifice. It should be noted that the pressure downstream of the orifice will vary along with the general shape of the curves previously described but the orifice 53 provides a dampening action which will reduce the pressure differences at the ports 37 and, accordingly, at the discharge nozzle of the fuel injector 33 when the injector valve 21 is opened. As a result, it is much easier to provide uniform fuel discharge regardless of the timing of opening of the injection valve 21 relative to the pressure in the combustion chamber.

Figure 7:
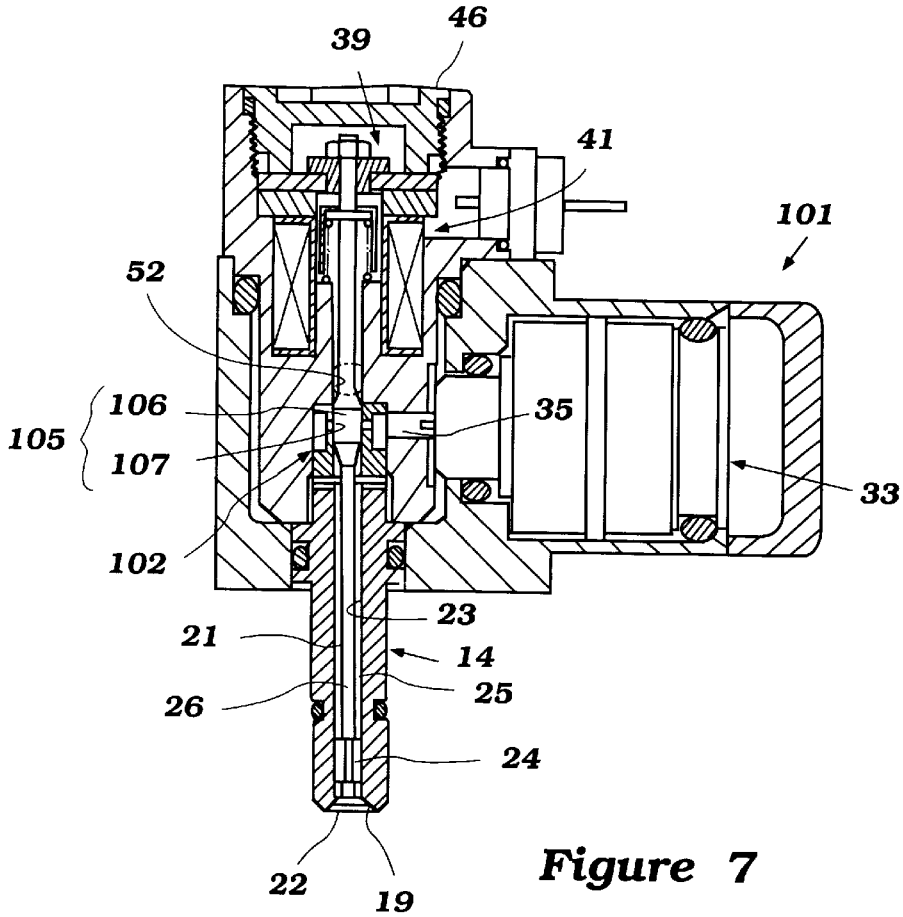
FIG. 7 is a cross sectional view, in part similar to FIG. 1, and shows another embodiment of the invention.
Figure 8:
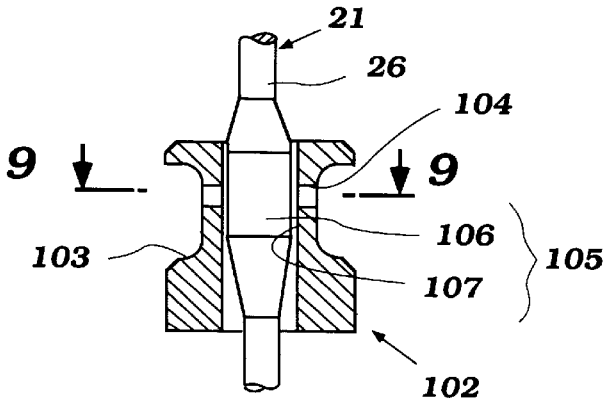
FIG. 8 is an enlarged cross sectional view of a portion of the injector of this embodiment.
Figure 9:
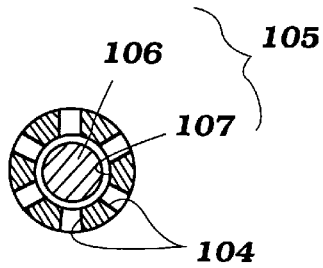
FIG. 9 is a cross sectional view taken along the line 9—9 of the FIG. 8.
Figure 10:
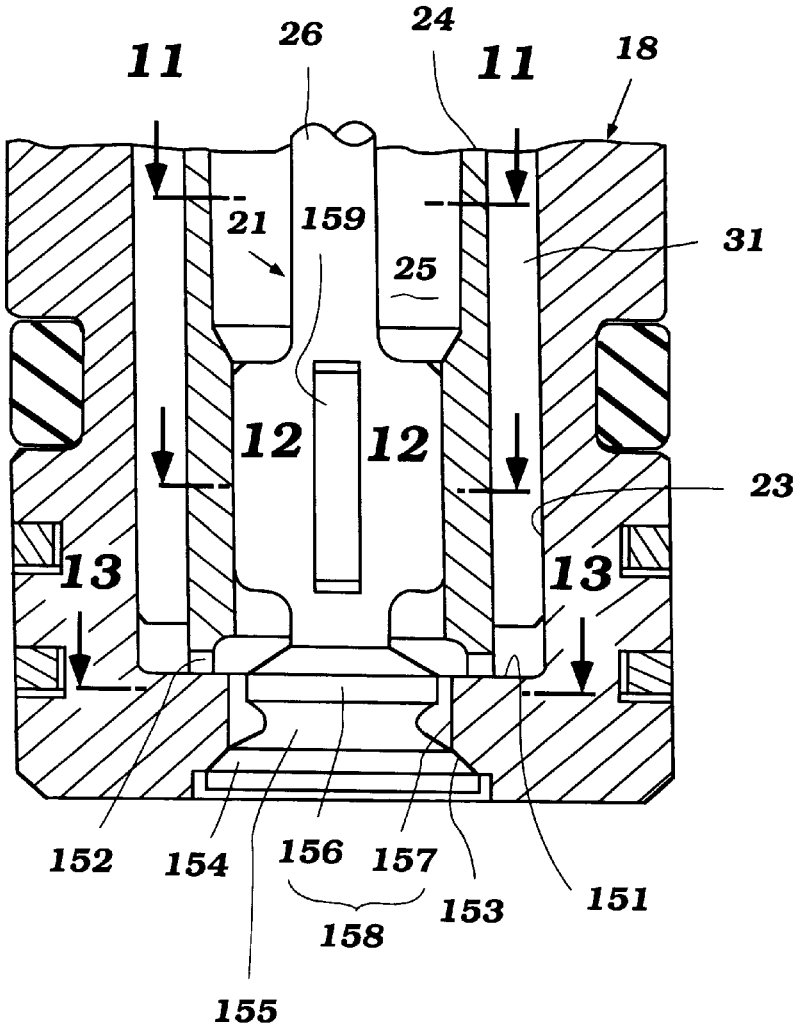
FIG. 10 is an enlarged cross sectional view, in part similar to FIG. 2, and shows another embodiment of the invention.
Figure 11:
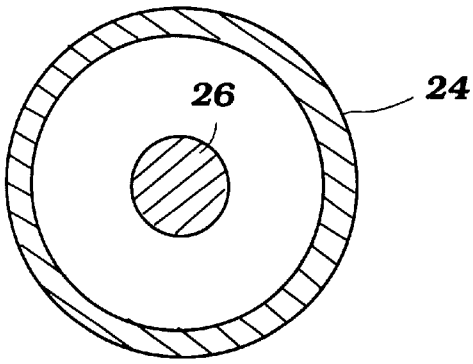
FIG. 11 is a cross sectional view taken along line 11—11 of FIG. 10.
Figure 12:
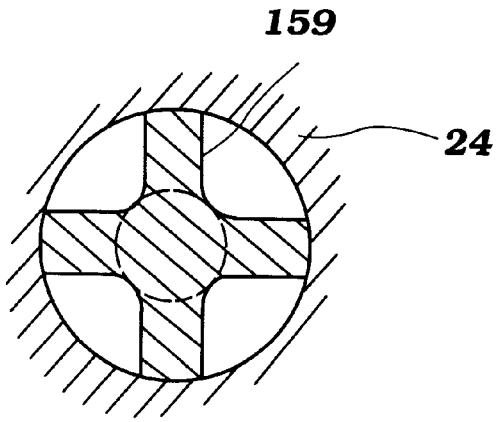
FIG. 12 is a cross sectional view taken along the line 12—12 of FIG. 10.
Figure 13:
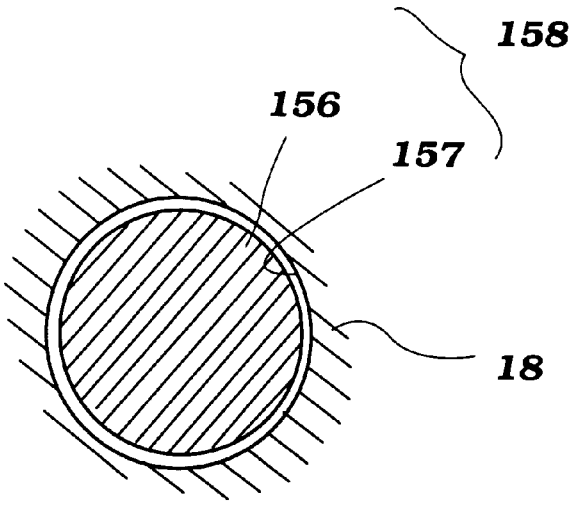
FIG. 13 is a cross sectional view taken along the line 13—13 of FIG. 10.

In the embodiment of the invention as thus far described, the restricting orifice 53 was positioned between the injector valve head 22 and the point of admission of both the fuel through the port 37 and air from the port 52 to the chamber 25. In addition, the orifice 53 was provided by a portion of the insert piece 24 and an enlarged portion 54 of the stem of the injector valve 21. FIGS. 7 through 9 show another embodiment of the invention wherein the orifice is provided directly in confronting relationship to the ports through which the fuel is injected but again between the point of air admission and the injector nozzle. An air fuel injector constructed in accordance with this embodiment of the invention, is identified generally by the reference numeral 101. Although the injector 101 has a different configuration from that of the injector 11 of the embodiment of FIGS. 1 through 5, the basic components are the same and thus have been identified by the same reference numerals. It should be noted that the fuel injector 33 in this embodiment extends perpendicularly to the longitudinal axis of the injector 101 rather than at an acute angle as in the previously described embodiment. Also, in this embodiment, the insert piece 24 is not employed and the chamber 25 is formed directly between the injector valve 21 and the bore 23 of the nozzle piece 14. Aside from these differences and the manner in which the orifice is formed, now to be described, it is believed that those skilled in the art can readily understand the construction and operation of this embodiment without reference to the details of the main components of the injector 101.

In this embodiment, an insert piece 102 is inserted into the housing assembly in confronting relationship to the fuel discharge port 35 from the injector 33. The insert piece 102 has a circumferential recess 103 that communicates with the port 35 and a plurality of radially extending passages 104 permit the fuel to flow from the recess 103 toward the cavity 25. However, a restricted orifice, indicated generally by the reference numeral 105 is formed by an enlarged portion 106 of the injector valve 21 and a bore 107 of the insert piece 102. The bore 107 is generally a straight bore and hence the sole restriction is formed by the enlarged diameter portion 106 of the injector valve 21. It should be noted that the length of the portion 106 is such that is will always obstruct the passageways 104 regardless of the axial position of the injector valve 21. That is, this restriction is provided whether the injector valve is opened or close and it not dependent upon the opened or closed position of the valve. It should be readily apparent that this construction also isolates the pressure between the valve head 22 and the valve seat or nozzle port 19 from the discharge of the fuel injector 33 and thus provides the advantageous results of the previously described embodiment.

In the embodiments of the invention as thus far described, the fuel has been introduced to the chamber 25 upstream of the valve stem portion 27 that serve to slideably support the valve stem 26 within the housing assembly 12. Although this construction has certain advantages, it means that the point of fuel discharged is spaced at some distance between the valve seating area defined by the valve head 22 and the valve seat 19. This can reduce the responsiveness of the engine to changes in running conditions. FIGS. 10 through 13 show another embodiment of the invention, which is generally similar to the embodiments of FIGS. 1 through 5, but wherein responsiveness is improved. Since this embodiment differs from the previously described embodiment of FIGS. 1 through 5 only in the area where fuel is injected and also wherein the orifice is formed in a slightly different manner, all components which are the same as the previously described embodiment have been identified by the same reference numeral and will not be described again, except in so far as is necessary to understand the construction and operation of this embodiment.

In this embodiment, the insert piece 24 does not have an enlarged diameter lower end but rather abuttingly engages a shoulder 151 formed at the base of the pilot portion counter bore 23. As a result, the fuel channel 31 extends all the way down to this face. A plurality of radially extending ports 152 extend through the insert piece 24 adjacent the shoulder 151 and hence permit fuel to be introduce directly adjacent the valve seating area.

In this embodiment, the valve seating area is provided by a valve seat 153 which is formed by the nozzle piece 18 and a head 154 of the injector valve 21. There is provided a waisted portion 155 above the head 154 and which terminates at an enlarged diameter portion 156 which cooperates with a cylindrical portion 157 of the nozzle piece 18 to form a damping orifice 158. The dampling orifice 158 controls the flow from the chamber 25 through the valve when opened.

In the embodiment, rather than a triangular section, the valve stem 26 is formed with a cruciform section 159 for providing slideable support. It is to be understood, however, that a triangular section also may be employed in conjunction with this embodiment.

In the embodiment, the enlarged diameter portion 156 is always within the bore 157 regardless of the degree of opening of the injector valve 121 and hence the aforenoted damping characteristics for damping combustion chamber pressure from the point of fuel injection will be enjoyed.

Figure 14:
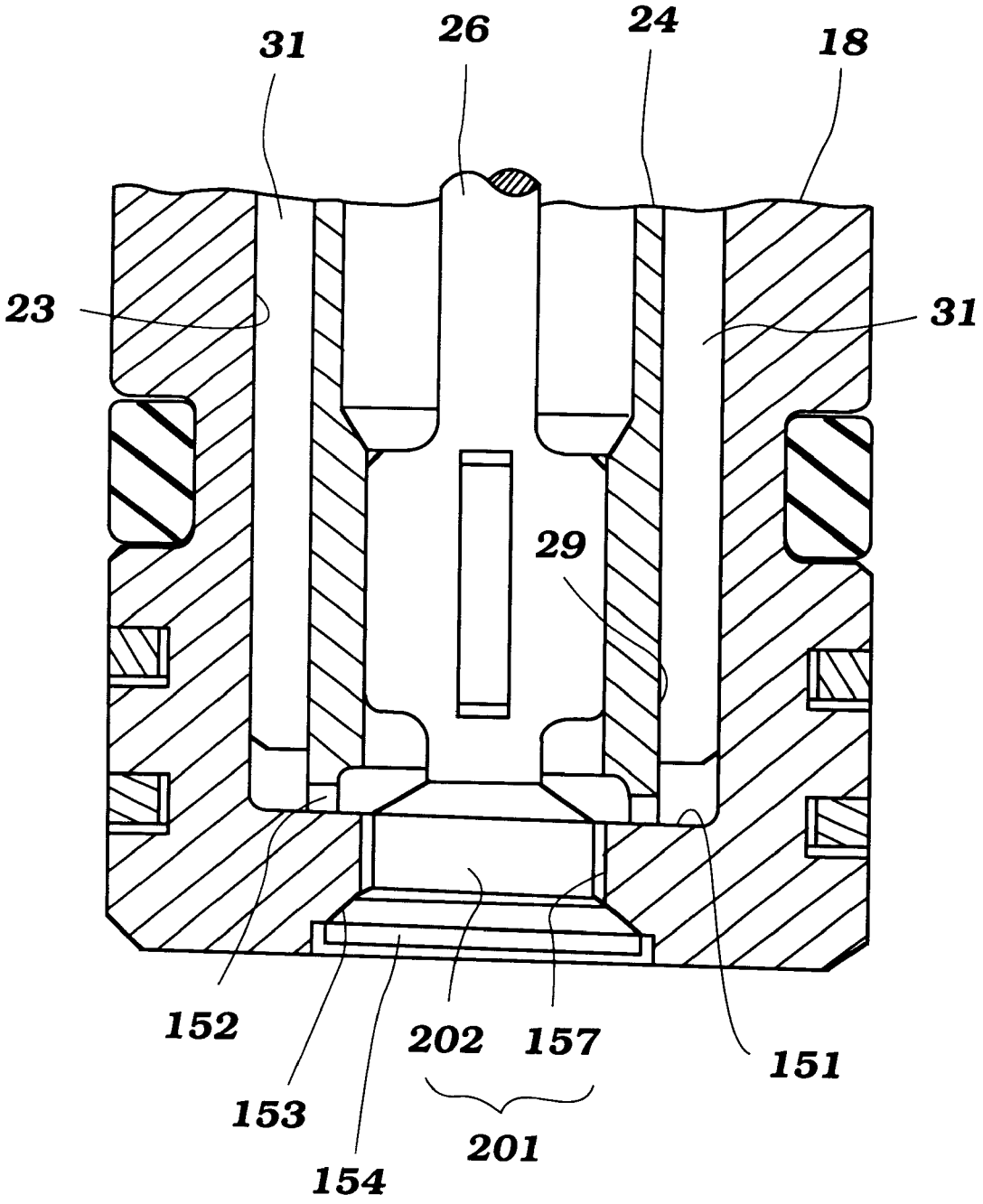
FIG. 14 is a cross sectional view, in part similar to FIGS. 2 and 10, and shows yet another embodiment of the invention.

FIG. 14 shows another embodiment of the invention which is generally the same as the embodiment of FIGS. 10 through 13 and, for that reason, only the differences between this embodiment and the previously described embodiment are believed to be necessary. In this embodiment, a flow restricting orifice 201 is formed by the bore 157 of the nozzle piece and a cylindrical portion 202 of the valve head. The cylindrical portion 202 dispenses with the necessity of providing the waisted section 155 of the previously described embodiment while obtaining the same advantages.

It should be readily apparent from the foregoing description that the described embodiments of the invention are very effective in providing a fuel air injector that will permit accurate control of the amount of fuel injected and regardless of whether or not the fuel injector is injecting at such times when the injection valve is opened and regardless of the combustion chamber pressure or variations in the distance between the injection valve and its seat as caused by manufacturing variations or deformations which occur during use. Although four embodiments of the invention have been illustrated and described, various changes and modifications may be made without departing from the spirit and scope of the invention, as defined by the appended claims.

What is claimed is:

1. An air fuel injector for injecting fuel and air into a high pressure area of an internal combustion engine comprising a housing defining a chamber, a nozzle port for communicating said chamber with the high pressure air of the engine, an injector valve for opening and closing said nozzle port and the communication of said chamber with said high pressure area, a fuel injector for injecting fuel into said chamber at least during the time when said injector valve is open, and means for restricting the communication of the area between said nozzle port and said injection valve, when open, with the area of said chamber to which fuel is injected by said fuel injector at least when said injector valve is opened and when said fuel injector is injecting fuel.

2. An air fuel injector as set forth in claim 1 wherein the means for restricting the communication comprises an orifice.

3. An air fuel injector as set forth in claim 2 wherein the orifice is defined at least in part by a portion of the injector valve.

4. An air fuel injector as set forth in claim 3 wherein the orifice is further defined by the portion of the injector valve and a portion of the housing defining the chamber.

5. An air fuel injector as set forth in claim 4 wherein the injector valve comprises a poppet type valve having a head portion controlling the flow through the nozzle port and a stem portion connected to an actuator and defining at least in part the orifice.

6. An air fuel injector as set forth in claim 5 further including means for delivering air to the chamber upstream of the orifice from the nozzle port.

7. An air fuel injector as set forth in claim 5 wherein the orifice is positioned in confronting relationship to the point of discharge of the fuel injector into the chamber.

8. An air fuel injector as set forth in claim 2 further including means for delivering air to the chamber upstream of the orifice from the nozzle port.

9. An air fuel injector as set forth in claim 2 wherein the orifice is positioned in confronting relationship to the point of discharge of the fuel injector into the chamber.

10. An air fuel injector as set forth in claim 8 wherein the injector valve comprises a poppet valve having a reduced diameter stem portion with a configured part for slideably supporting said injector valve for reciprocation within the housing while permitting flow past said configured portion.

11. An air fuel injector as set forth in claim 10 wherein the orifice is formed downstream of the configured portion of the valve stem and wherein the fuel is delivered downstream of the configured end of the valve stem portion.

12. An air fuel injector as set forth in claim 10 wherein the orifice is formed downstream of the configured portion of the valve stem and wherein the fuel is delivered downstream of the configured end of the valve stem portion.

13. An air fuel injector as set forth in claim 1 wherein the injector valve comprises a poppet valve having a reduced diameter stem portion with a configured part for slideably supporting said injector valve for reciprocation within the housing while permitting flow past said configured portion.

14. An air fuel injector as set forth in claim 13 wherein the orifice is formed downstream of the configured portion of the valve stem and wherein the fuel is delivered downstream of the configured end of the valve stem portion.

15. An air fuel injector as set forth in claim 13 wherein the orifice is formed downstream of the configured part of the valve stem and wherein the fuel is delivered downstream of the configured part of the valve stem portion.

* * * * *

UNITED STATES PATENT AND TRADEMARK OFFICE

CERTIFICATE OF CORRECTION

PATENT NO. : 6,371,093 B1
DATED : April 16, 2002
INVENTOR(S) : Junichi Kaku et al.

It is certified that error appears in the above-identified patent and that said Letters Patent is hereby corrected as shown below:

Column 1,
Line 14, delete “a” before the word “defines”.
Lines 32 and 33, delete “the pressure variations … combustion chamber and”.

Column 2,
Line 18, delete “the”.
Line 23, after “along” insert -- the --.

Column 4,
Line 55, delete “35” and insert -- 33 --.

Column 5,
Line 59, delete “close” and insert -- closed --; and delete “it” and insert -- is --.

Column 6,
Line 25, delete “introduce” and insert -- introduced --.
Line 32, delete “157” and insert -- 167 --.
Line 33, delete “dampling” and insert -- damping --.

Column 7,
Line 5, delete “air” and insert -- area --.
Line 10, before “means” insert -- restricting --.
Line 14, after “fuel” insert the following sentence:
-- , said restricting means being sized so as to reduce the pressure within the area of said chamber where said fuel unjector unjects fuel during the time of fuel injection will be maintained substantially constant even when said injector valve is open. without obstructing the amount of fuel and air that can be injected. --

UNITED STATES PATENT AND TRADEMARK OFFICE

CERTIFICATE OF CORRECTION

PATENT NO. : 6,371,093 B1
DATED : April 16, 2002
INVENTOR(S) : Junichi Kaku et al.

It is certified that error appears in the above-identified patent and that said Letters Patent is hereby corrected as shown below:

Column 8,
Lines 13 and 15, delete “portion” and insert -- part --.
Line 14, delete “downstream” and insert -- upstream --.
Lines 17 and 19, delete “portion” and insert -- part --.
Line 24, delete “while permitting” and insert -- without restricting --; and delete “portion” and insert -- part --.
Lines 26 and 28, delete “portion” and insert -- part --.
Line 27, delete “downstream” and insert -- upstream --.
Line 32, delete “portion” and insert -- part --.

Signed and Sealed this

Seventeenth Day of December, 2002

JAMES E. ROGAN
*Director of the United States Patent and Trademark Office*